US007849664B2

(12) United States Patent
Corbett et al.

(10) Patent No.: US 7,849,664 B2
(45) Date of Patent: Dec. 14, 2010

(54) AUTOMATED FLOWABLE DUNNAGE DISPENSING SYSTEM AND METHOD

(75) Inventors: James J Corbett, Highland Heights, OH (US); Joseph J Harding, Mentor, OH (US); Charles D Molitor, Concord, OH (US); Michael A Pintz, Cleveland, OH (US); Scott J Williams, Rocky River, OH (US); Rapheal R Still, Cleveland, OH (US); Timothy E Sull, Avon, OH (US); Ronald Rich, Burton, OH (US); David A Pierson, Lakewood, OH (US); Paul C Gilles, Amherst, OH (US)

(73) Assignee: Ranpak Corp., Concord Township, OH (US)

( * ) Notice: Subject to any disclaimer, the term of this patent is extended or adjusted under 35 U.S.C. 154(b) by 497 days.

(21) Appl. No.: 11/718,408

(22) PCT Filed: Nov. 2, 2005

(86) PCT No.: PCT/US2005/039446

§ 371 (c)(1),
(2), (4) Date: May 2, 2007

(87) PCT Pub. No.: WO2006/050354

PCT Pub. Date: May 11, 2006

(65) Prior Publication Data

US 2009/0064638 A1 Mar. 12, 2009

Related U.S. Application Data

(60) Provisional application No. 60/624,348, filed on Nov. 2, 2004.

(51) Int. Cl.
*B65B 23/00* (2006.01)
*B65B 57/00* (2006.01)

(52) U.S. Cl. ..... 53/472; 53/55; 53/267

(58) Field of Classification Search ..... 53/468, 53/472, 115, 52, 55, 239, 267, 271, 376.3, 53/377.6, 376.4; 493/25, 967
See application file for complete search history.

(56) References Cited

U.S. PATENT DOCUMENTS 2,855,741 A * 10/1958 Shaw et al. ..... 53/377.3

(Continued)

FOREIGN PATENT DOCUMENTS

WO 2004/041653 A 5/2004

*Primary Examiner*—Paul R Durand
(74) *Attorney, Agent, or Firm*—Renner, Otto, Boisselle & Sklar, LLP

(57) ABSTRACT

A system (10) for dispensing dunnage material includes a chute (30) connectable to a supply (20, 40) of flowable dunnage. A container (12) or a bottom of the chute (30) is moved into a dispensing position where the bottom of the chute (30) is proximate the fill plane of the container (12). A controller (16) selectively opens a shutter (50) at the bottom of the chute (30) to dispense dunnage and then closes the shutter (50) to separate the dispensed dunnage from the dunnage in the chute (30) while also removing the dunnage above the fill plane of the container (12). The chute (30) includes at least one substantially horizontal plate member (54) that is openable to selectively vary the size of an aperture (52) created thereby at the bottom of the chute (30) for dispensing dunnage material therethrough.

14 Claims, 7 Drawing Sheets

U.S. PATENT DOCUMENTS 3,708,208 A * 1/1973 Fuss ..... 406/144
3,762,772 A * 10/1973 Fuss ..... 406/1
3,976,030 A 8/1976 Ragsdale et al.
4,202,387 A * 5/1980 Upton ..... 141/360
4,524,560 A * 6/1985 Goodman ..... 53/377.3
4,799,830 A * 1/1989 Fuss ..... 406/117
4,922,687 A * 5/1990 Chow et al. ..... 53/472
5,178,196 A * 1/1993 Garacci ..... 141/67
5,323,819 A * 6/1994 Shade ..... 141/65
5,383,837 A 1/1995 Watts et al.
5,491,333 A * 2/1996 Skell et al. ..... 250/222.1
5,544,468 A * 8/1996 Harrison et al. ..... 53/390
5,623,815 A * 4/1997 Hornstein et al. ..... 53/472
5,637,071 A * 6/1997 Simmons et al. ..... 493/464
5,647,910 A 7/1997 Brown et al.
5,719,678 A * 2/1998 Reynolds et al. ..... 356/627
5,826,725 A 10/1998 Hornstein et al.
5,829,231 A * 11/1998 Harding et al. ..... 53/493
5,960,990 A * 10/1999 Radosevich ..... 222/1
6,055,795 A * 5/2000 Harding et al. ..... 53/503
6,100,518 A * 8/2000 Miller ..... 250/222.1
6,672,037 B2 * 1/2004 Wehrmann ..... 53/472
7,353,850 B2 * 4/2008 Greiwe et al. ..... 141/279
2002/0139092 A1 10/2002 Wehrmann
2003/0114288 A1 * 6/2003 Harding et al. ..... 493/464
2004/0059463 A1 * 3/2004 Coughlin ..... 700/229
2008/0021734 A1 * 1/2008 Mallett et al. ..... 705/2

* cited by examiner

AUTOMATED FLOWABLE DUNNAGE DISPENSING SYSTEM AND METHOD

This application claims the benefit of International Patent Application No. PCT/US2005/039446, filed Nov. 2, 2005, published in English as Publication No. WO 2006/050354 A2, which claims the benefit of U.S. Provisional Application No. 60/624,348, filed Nov. 2, 2004, which are hereby incorporated herein by reference.

FIELD OF THE INVENTION

This invention relates generally to an automatic dunnage dispensing system and method for automatically filling the void in a container in which one or more objects have been placed for shipping, and more particularly to a dunnage system and method for automatically dispensing a flowable dunnage into a container.

BACKGROUND

In the process of shipping one or more articles from one location to another, a packer can top-fill a container in which one or more articles have been placed with a flowable dunnage to partially or completely fill the void around the article or articles and thereby prevent or minimize any shifting movement of the objects relative to the container and/or to provide cushioning for the articles in the container.

The packer typically observes the container as it is being filled with dunnage and stops a dunnage dispenser when the container appears to be full. Some packers tend to over-fill the container, with the result that more dunnage material might have been placed in the container than is needed to adequately protect the article. At other times, a packer might under-fill the container, in which case the article might be free to move around in the container during shipment, increasing the possibility of damage. Both over-filling and under-filling typically becomes more of a problem as the speed of the dispenser increases. Currently there are void-fill dispensers, in particular paper dunnage converters, that can deliver a strip of dunnage at rates in excess of fifty feet per minute (about 0.25 meters per second).

Some attempts have been made to automate one or more aspects of the dunnage filling process to avoid or minimize these and other problems. For example, in one known system, disclosed in U.S. Pat. No. 6,527,147, a packer steps on a foot pedal to dispense air bags from an overhead supply. Using a foot pedal frees the packer's hands to distribute the air bags within the container. This system does not resolve the problems of over-filling or under-filling, however.

One solution to the over-filling and under-filling problem is provided by a system disclosed in International Application Publication No. WO 2004/041653. In this system, a probe senses the void around an article in a container, and a controller then cooperates with a dunnage converter to produce an amount of dunnage adequate to fill the void. As the dunnage is being dispensed, a packer assists in guiding and/or placing the dunnage into the container. Measuring the void volume accurately, however, is very difficult and attempting to do so adds to the complexity and expense of the system.

Rather than attempting to measure the void volume, another system described in U.S. Pat. No. 4,922,687 intentionally overfills the container and then uses blasts of air to level the dunnage before the container is closed and sealed for shipping. The excess dunnage is then recirculated for reuse. By automating the dispensing process, this system frees a packer to perform other tasks, but this system requires a recirculation system, however, which adds complexity and cost to the dispensing system.

SUMMARY

The present invention provides a system, and related components and methods, for automatically supplying a void-fill dunnage to a container without the need for a packer to guide or place the dunnage in the container. Moreover, the void in the container can be filled with the proper amount of dunnage without having to measure the amount of void in the container. More specifically, the present invention provides a system and method for dispensing a flowable dunnage, which sometimes is referred to as loose-fill dunnage, into a container.

An exemplary dunnage dispensing system comprises a dispenser including a variable size outlet through which dunnage can flow into a container, whereby the size of the opening can be varied for filling different sizes of containers, and a shutter for opening and closing the outlet. The extent to which the shutter opens can be varied to define the variable size outlet when open.

In accordance with another aspect of the invention, a method of dispensing a flowable dunnage into a container comprises the steps of adjusting the size of an aperture at the outlet of a dunnage dispenser while the aperture is closed by a shutter, relatively positioning the outlet of the dunnage dispenser above an open container, and opening the shutter to allow dunnage to flow into the container. The positioning step can further include moving the outlet to a position in close proximity to the top edge or edges of the side wall or walls of the container. The method can further include the step of sensing a dimension of a container, such as a height, width, or depth dimension or combinations thereof.

According to another aspect of the invention, a method of dispensing a flowable dunnage into a container comprises the steps of relatively positioning an outlet of a dispenser such that a shutter closing the outlet is located in close proximity to the top edge or edges of the side wall or walls of a container, moving the shutter from its closed position through a plane that is parallel to the top edge or edges to open the shutter to allow dunnage to flow from the dispenser into the container, and then moving the shutter to its closed position.

According to another aspect of the invention, a dunnage dispensing system comprises a dispenser including an outlet through which dunnage can flow into a container, the outlet being bounded by a rim residing in a plane, and a shutter movable in a plane parallel to and closely adjacent the plane of the rim for opening and closing the outlet.

According to still another aspect of the invention, a dunnage dispensing system comprises a dispenser having a plurality of outlets which can be individually selectively opened to dispense dunnage from selected portions of an area corresponding to the collective areas of the plurality of outlets, and a controller for controlling opening and closing of the outlets.

In accordance with another aspect of the invention, a method of dispensing a flowable dunnage into a container comprises the steps of selectively and independently opening one or more of a plurality of outlets to dispense dunnage therefrom over an area.

In accordance with another aspect of the invention a dunnage dispensing system comprises a container support for supporting a container, a dispenser having one or more outlets which can be individually selectively opened to dispense dunnage toward an area of the container support, at least one sensor for measuring a distance from the container support for determining a fill level in the container, and a controller for controllably opening and closing the one or more outlets based on input from the at least one sensor.

According to still another aspect of the invention, a dunnage dispensing system comprises a dunnage dispenser for overfilling a container with flowable dunnage, a container support for supporting a container, and a wiper spaced above the container support and movable relative to a top edge or edges of the side walls of the container for removing excess dunnage.

According to yet another aspect of the invention, a method of dispensing a flowable dunnage into a container comprises the steps of overfilling a container with dunnage and removing excess dunnage by moving a wiper member relative to the container. The wiper member is spaced above a top edge or edges of a side wall or walls of the container. The removing step can include rotating the wiper member across the top edge or edges of the container, or the removing step can include moving the container under the wiper member.

According to another aspect of the invention, an automated dunnage filling system comprises a chute for containing a quantity of dunnage material, a shutter at the bottom of the chute, and a controller that can selectively open the shutter to dispense dunnage material and close the shutter to separate the dispensed dunnage material from the dunnage material in the chute.

In accordance with another aspect of the invention, a method of dispensing dunnage material comprises the following steps: registering a container in a container position; positioning a chute in a dispensing position relative to the container position; opening a shutter to dispense dunnage material from the chute into the container; closing the shutter to separate the dispensed dunnage material from the dunnage material in the chute; and moving the chute or the container away from the dispensing position.

In accordance with another aspect of the invention, a system includes a chute connectable to a supply of dunnage material for filling the chute with the dunnage material. A controller is operative to open a shutter at the bottom of the chute to allow dunnage material to flow through a shutter aperture and then to close the shutter to separate the thereby dispensed dunnage material from dunnage material in the chute at a level coinciding with a fill plane of the container.

In an exemplary embodiment, the chute includes at least one substantially horizontal plate member that is openable to selectively vary the size of the aperture created thereby at the bottom of the chute for dispensing dunnage material therethrough. The chute can include multiple plate members for varying the size of the aperture in multiple directions. More particularly, a pair of overlapping plate members movable in orthogonal directions can be used to vary the size and shape of the aperture at the bottom of the chute through which the dunnage material can pass into a container beneath the bottom of the chute.

The system can include a sensor for detecting at least one dimension of the container to be filled and supplying to a controller information indicative of the detected dimension or dimensions. Based on such information, the controller controls the open size of the shutter aperture in the bottom of the chute such that the size is less than or about equal to a dimension or dimensions of the container opening. A height dimension of the container also can be detected and the controller can control relative movement of the container or the bottom of the chute or both thereby to locate the bottom of the chute in close proximity to the top of the container.

For containers such as boxes with flaps, the system can also include at least one flap pusher to move the flaps of the container outwardly and clear of the chute, as the bottom of the chute and the container position move toward a dispensing position whereat the bottom of the chute is located at about the horizontal plane defined by the upper edges of the side walls of the container. In an exemplary embodiment the flap pusher is connected to and moves with the shutter.

The present invention also provides a method of dispensing dunnage material that includes the steps of registering an open top of a container to the bottom of a chute, opening a shutter to dispense dunnage material from the chute into the container, and closing the shutter to separate the dispensed dunnage material from the dunnage material in the chute. Registration is effected by vertically aligning the chute and open top of the container such that a shutter aperture in the bottom of the chute will, when open, be aligned with the open top of the container. In addition, the bottom plane of the chute can be vertically positioned in close proximity to the top plane of the container.

Generally, at least a bottom portion of the chute can be moved vertically toward and away from a support for a container and/or the support can move toward and away from the chute. The relative movement between the chute and the container can be used to open any container flaps so that the top plane of the side walls of the container can be brought into close proximity with the bottom plane of the chute.

The present invention also provides a dunnage dispensing system as shown in the drawings and described in the text.

The foregoing and other features of the invention are hereinafter fully described and particularly pointed out in the claims, the following description and the annexed drawings setting forth in detail certain illustrative embodiments of the invention, such being indicative, however, of but a few of the various ways in which the principles of the invention may be employed.

DETAILED DESCRIPTION

Figure 1:
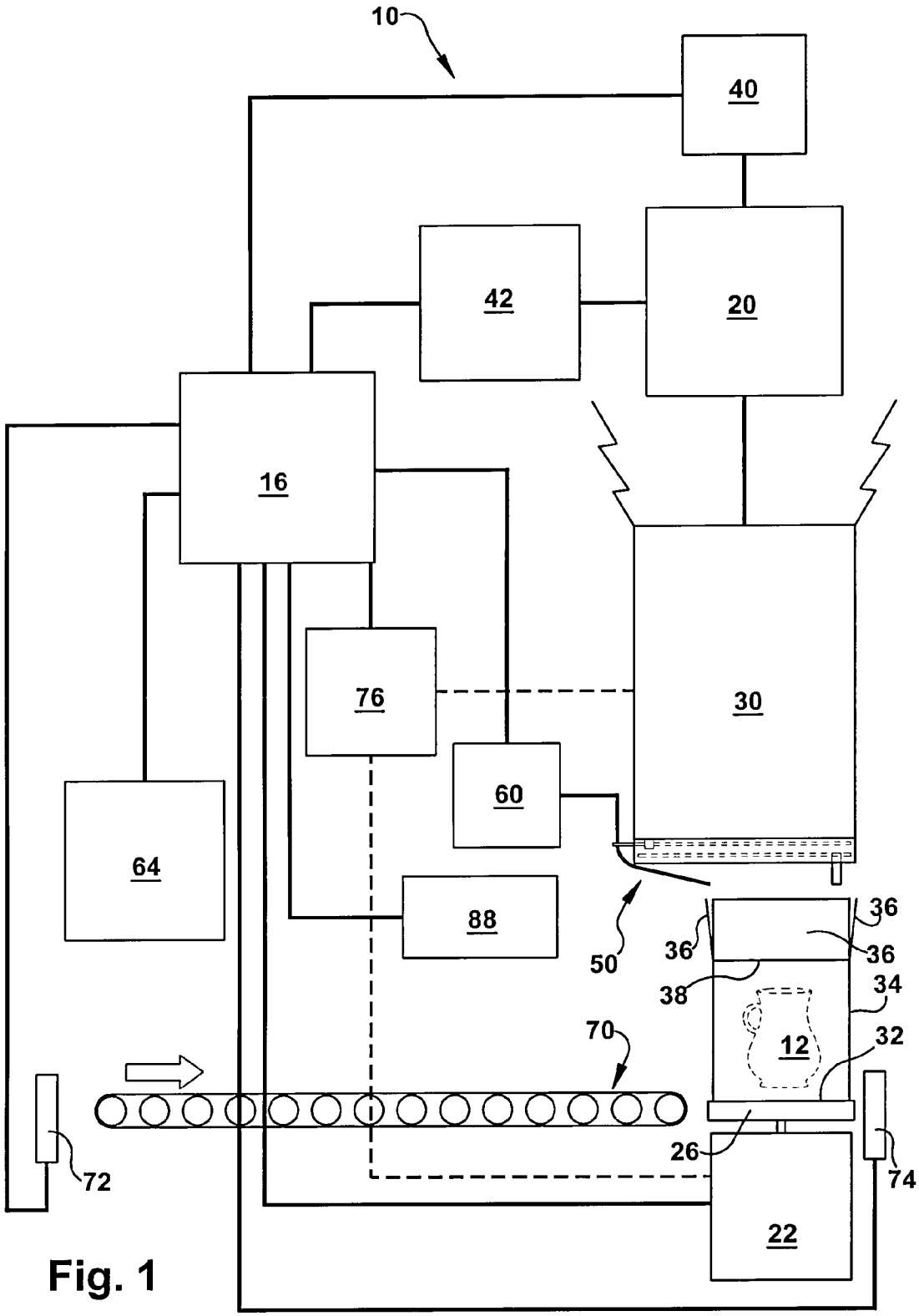
FIG. 1 is a schematic and diagrammatic view of an automated dunnage filling system according to the present invention.

Referring initially to FIG. 1, an exemplary automated dunnage dispensing system according to the invention is indicated generally by reference numeral 10. The system 10 is operable to automatically supply a flowable void-fill dunnage 11 (FIG. 3) to a container 12. This can be done without first measuring the void volume or significantly under-filling or over-filling the container in which one or more articles or objects 14 (FIG. 3) are packed for shipping.

The system 10 generally comprises a controller 16, a supply 20 of dunnage material, a registration system 22, a container support 26 for supporting the container 12, and a chute 30 for dispensing the dunnage into the container. As used herein, the terms dunnage and dunnage material are interchangeable.

Figure 3:
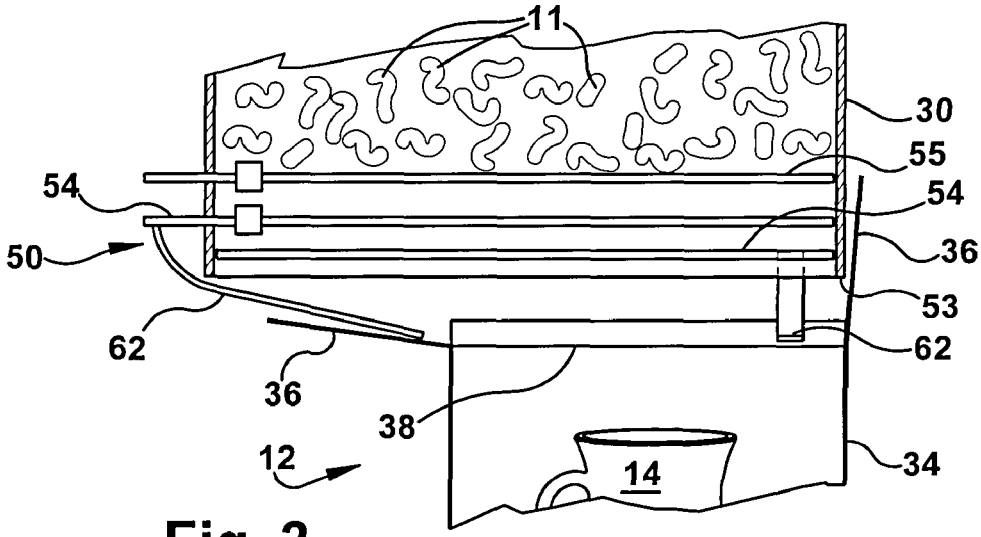
FIG. 3 is a cross-sectional side elevation view of a modified dispensing chute and shutter in accordance with an aspect of the invention.
Figure 7:
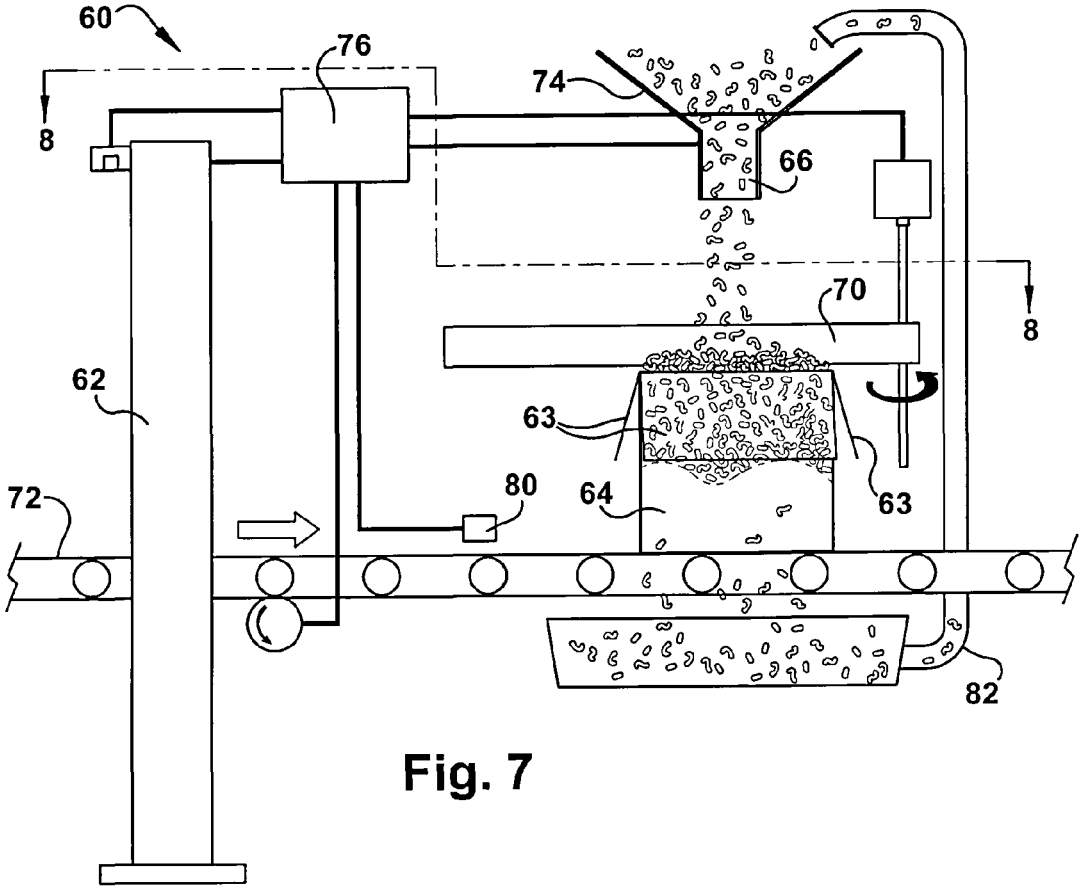
FIG. 7 is a schematic side view of yet another automated dunnage filling system according to the present invention.

An exemplary container 12 is a rectangular cardboard box, as shown in FIGS. 1 and 3. A typical box has a closed bottom 32, substantially vertical side walls 34 perpendicular to the bottom and to adjacent side walls 34, and four flaps 36 extending upward from top edges of the side walls to bound a generally rectangular opening at the top of the container. The flaps 36 are foldable along a horizontal fold line 38 at the top edge of the side walls to close the opening at the top of the container 12. The top edges of the side walls 34 define a top plane of the container 12 at the fold line 38. To facilitate filling the void around the articles 14 in the container 12 with dunnage 11 from the supply 20, the flaps 36 can remain upright and aligned with respective sides of the container to help capture the dunnage therein or the flaps 36 can be folded outward, as shown in FIG. 7, for example.

In place of or in addition to such a rectangular container, the system 10 can also dispense dunnage to a container having a different shape, such as a cylindrical container. A cylindrical container has a circumferential side wall, a circular bottom wall, and a circular top edge which defines the top plane. Like some rectangular containers, a cylindrical container does not have flaps, but instead is closed by a lid placed over the open end of the container after the void is filled with dunnage.

The system 10 dispenses dunnage to the container 12 from the supply 20. Preferably, the dunnage is a flowable dunnage product, such as a type of dunnage product referred to as "peanuts." Exemplary flowable dunnage includes but is not limited to foam peanuts, paper peanuts and air bags, for example.

The supply 20 of dunnage can include a bin or hopper or other way to store and provide dunnage to the chute 30 and the container 12 as needed. The dunnage can be produced on-site or at a remote location. To produce dunnage, a dunnage converter 40 optionally can be used to convert a stock material into a dunnage product 11 and provide it to the supply 20. The system 10 also can include a sensor 42 for monitoring the amount of dunnage 11 in the supply 20. Based on signals from the dunnage supply sensor 42, the controller 16 can control the converter 40 to produce dunnage 11 as needed to maintain the supply 20 of dunnage ready for dispensing.

Figure 2:
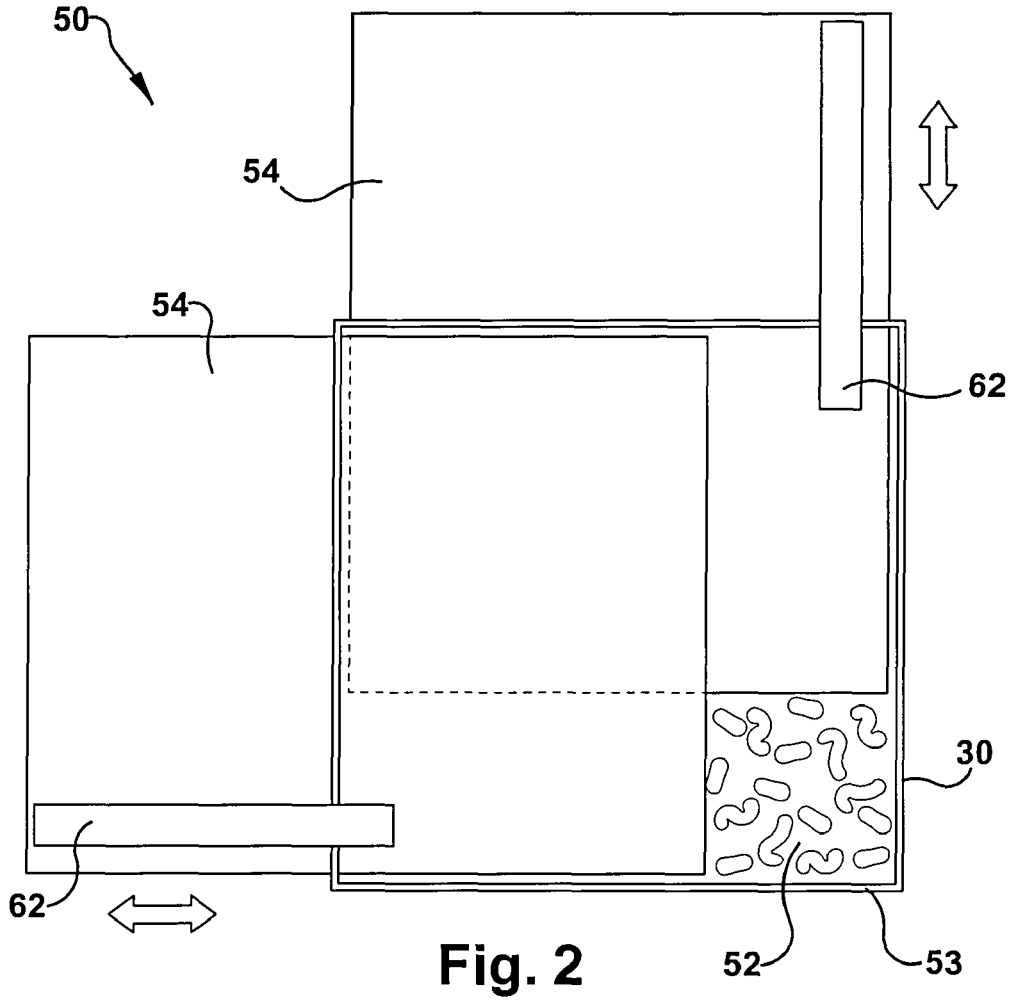
FIG. 2 is a bottom view of an outlet of a dispensing chute and an exemplary shutter portion of the system of FIG. 1.

The chute 30 guides the dunnage from the supply 20 to the container 12, and typically includes a generally vertical passage for the downward flow of dunnage therethrough and out an outlet by the force of gravity or otherwise. Referring to FIGS. 1-3, an exemplary chute 30 has a substantially rectangular cross-sectional shape and is formed of sheet metal. A rim 53 at the bottom of the chute 30 bounds the outlet of the chute 30, and typically resides in a horizontal plane. An upper end of the chute 30 is configured to receive dunnage 11 from the dunnage supply 20, and a lower end of the chute 30 includes a shutter 50 that opens and closes an aperture 52 (FIG. 2) at the outlet of the passage through the chute 30.

The illustrated shutter 50 defines a substantially horizontal shutter plane at an outlet at the bottom of the chute 30. In the illustrated embodiment the shutter includes at least one substantially horizontal leaf or plate member 54 that is operable to selectively vary the size of the aperture 52 created thereby at the outlet for dispensing dunnage 11 therethrough. The shutter 50 includes multiple plate members for varying the size of the aperture, including the illustrated pair of overlapping plate members 54. These plate members 54 also can be referred to as closure members. The plate members 54 are individually movable in orthogonal directions to selectively vary the size of the aperture 52 created at the bottom of the chute 30.

The shutter 50 not only includes the plate members 54 that define the aperture 52 through which the dunnage flows, but the illustrated shutter 50 also opens and closes the outlet to selectively pass dunnage therethrough. The illustrated plate members 54 both open the outlet and define the aperture 52. Alternatively, these functions can be separated. As shown in FIG. 3, while the aperture is defined by one or more plate members 54, the outlet of the chute 30 can be opened by a separate transversely movable shutter member 55 to allow the dunnage to flow therethrough to the container 12. The shutter member 55 is mounted at the outlet of the chute and adjacent to, above or below, the plate members 54. The shutter 50 is controllable via one or more actuators 60, independently moving each of the plate members 54 to open the aperture 52 to the desired dimension and the shutter member 55 to open the outlet to dispense dunnage 11, and controlling the shutter 50 to close the outlet and thereby separate the dispensed dunnage in the container 12 from the dunnage in the chute 30.

The system 10 preferably positions the shutter 50 and the outlet of the chute 30 proximate a fill line of the container 12. The fill line is the desired level at which the dunnage fills the container, which coincides with or is above the flap fold line at the top plane of the container 12. By positioning the shutter 50 at the fill line, in closing the shutter 50 the shutter also levels the dunnage 11 in the container 12 and separates excess dunnage above the fill line from the dunnage dispensed to the container 12. This aspect of the system 10 is described in more detail below.

The system 10 can also include a flap-moving assembly that includes one or more members, referred to as flap pushers 62, that are movable with members of the shutter 50 to encourage one or more flaps 36 of the container 12 to move outward, out from under the bottom of the chute 30, as the bottom of the chute 30 or the container support 26 move toward the dispensing position (shown in FIG. 4) where the dispensing outlet is proximate the container fill line. In an exemplary embodiment, the flap pusher 62 is a strip of sheet material connected to and movable with a plate member 54 of the shutter 50. The flap pusher 62 extends below the plate members 54 to engage a flap 36 when the shutter 50 opens. Friction between the flap pusher 62 and the flap 36 helps to urge the flap to move outward with the flap pusher as it moves with the plate member 54.

The system 10 can further include a sensor 64 upstream of the chute 30 for detecting at least one dimension of the container 12 to be filled. The sensor could alternatively detect a code or indicia that identifies the container and from which at least one dimension of the container could be determined, such as one or more of the width, length and height of the container. The controller 16 determines the dimensions of the opening in the container 12 from signals provided by the container sensor 64. The controller 16 then controls the shutter 50 to open to create the aperture 52 in the bottom of the chute 30. The aperture 52 typically has a size that is less than or equal to the dimensions of the container opening. This facilitates filling the container 12 without requiring a subsequent operation to spread the dunnage 11 within the container. The container sensor 64 also can detect a height dimension of the container 12. From this information, the controller 16 can control relative movement of the container support 26 or the outlet at the bottom of the chute 30 or both between the rest position shown in FIG. 1 and the dispensing position shown in FIG. 4 to fill the container 12 with dunnage 11.

Referring now to FIGS. 1-6, a method of operating the system 10 includes the following steps. First, a container 12 enters the system 10, such as via the illustrated conveyor 70, which is schematic only and representative of any type of conveyor that can move containers 12 through the system 10. Containers waiting to be filled can be held upstream by an upstream stop gate 72, for example, that can be controlled by the controller 16. The container sensor 64 detects a dimension or dimensions of the container 12. Assuming that the flaps 36 extend vertically, aligned with the side walls 34, which often is the case, the controller 16 can determine the length of the container 12 from the amount of time that the container sensor 64 detects the width or height of the container and the known speed of the conveyor 70 transporting the container. The measured height dimension can include the height of the flaps 36. The controller 16 generally can calculate what the height of the container 12 is when the flaps are folded down. For a common RSC-style container, for example, the flap length typically can be calculated as the measured height dimension less half (or other fraction) of the measured width dimension, whichever is perpendicular to the corresponding flap fold line 38. The calculation might be different for different types of containers.

As the container 12 approaches the chute 30, the container registration system 22 positions the container 12 in alignment with the outlet of the chute 30. This generally requires moving the container 12 or the outlet of the chute 30, or both, in one or more orthogonal horizontal and vertical directions. For example, the container 12 can be centered on the conveyor or other container support. Alternatively, the container 12 can be moved against one side of the container support. In an exemplary embodiment, the registration system registers at least one corner of the container 12 on the container support 26 at a container position. This locates a corner of the container 12 relative to the chute 30 and the outlet. The illustrated container support 26 is an extension of the conveyor 70 for positioning the container 12 in alignment with the outlet of the chute 30.

One way to register or position the container 12 is to use angled rollers to move the container to one side of the conveyor. Another way to register a container would be to use a pusher mechanism to engage the container 12 and move it toward a desired position, including to one side of the support or centered on the support. The controller 16 stops the container 12 with a downstream stop gate 74. Alternatively, the controller 16 can stop the conveyor 70 to position the container 12 under the outlet of the chute 30. Thus, for example, with the corner of the container registered relative to a corner of the chute and a corner of the outlet, the container 12 is in position to be filled with dunnage 11 from the chute 30.

Figure 4:
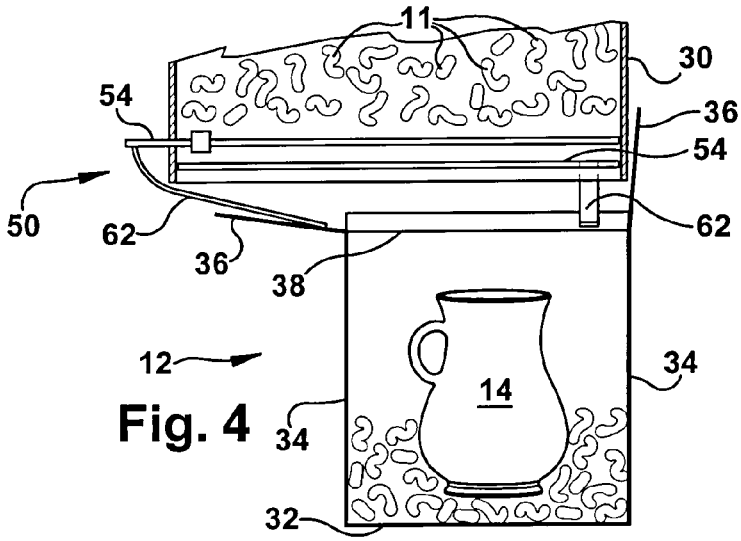
FIGS. 4-6 are sequential schematic cross-sectional elevation views of a chute provided as part of the system shown in FIG. 1 in relation to a container that is being filled with dunnage.
Figure 5:
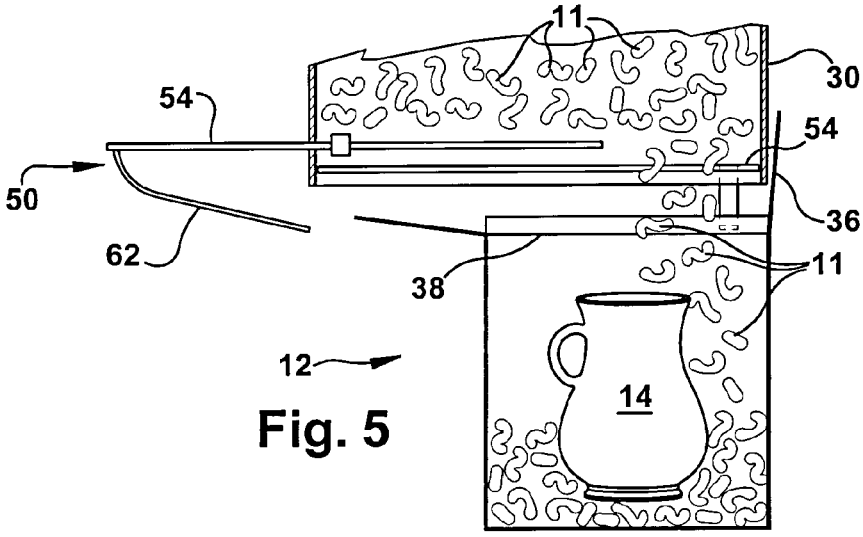
Figure 6:
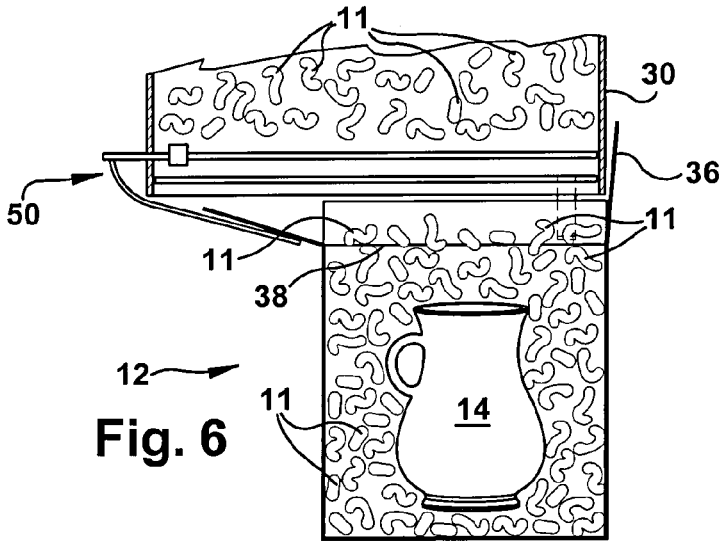

Via at least one movement actuator 76, the controller 16 controls relative movement of the outlet at the bottom portion of the chute 30 with respect to the container support 26 to place the shutter plane in proximity to the top of the container and the fill line, specifically at or above a top edge of a side wall 34. Thus the container support 26 or the outlet at the bottom of the chute 30, or both, is moved into the dispensing position where the outlet at the bottom of the chute is proximate the fill level of the container 12, as shown in FIGS. 4-6. The fill level generally is above the flap fold line 38.

The controller 16 determines how far to move the container support 26 or the bottom of the chute 30 based at least in part on a calculated height of the container 12 with the flaps folded out of the way and moves the container support, the chute, or both, to the dispensing position. Generally, the outlet and the bottom portion of the chute 30 are moved between the rest position (FIG. 1) and the dispensing position (FIG. 4) relative to the container support 26 where a container 12 presumably is registered. The bottom of the chute 30 typically is movable vertically toward and away from the container support 26, although it might also move in one or more directions transverse the vertical direction. The spacing between the shutter plane and the top of the container can be varied to provide the desired amount of overfill. Some overfill can be advantageous to accommodate settling of the dunnage during shipment and/or to apply some pressure to the dunnage when the container is closed. The container support 26 also can include a vibration table to encourage dunnage 11 to settle in the container 12. Alternatively or additionally, the controller 16 can control an actuator in the registration system 22 to move the container support 26 relative to the bottom of the chute 30.

The relative movement between the bottom of the chute 30 and the container support 26, in cooperation with the flap pushers 62, typically opens at least two adjacent flaps 36 of the container 12 (compare FIGS. 1 and 4). The shutter 50 can begin opening before the chute 30 reaches the dispensing position. Since in an exemplary embodiment the flap pusher 62 is attached to the shutter plate member 54, opening the shutter 50 also moves the flap pushers and this helps to open the flaps 36 in the container 12. Once the flaps are moved from an upright orientation to an approximately forty-five degree inclination relative to vertical, the bottom of the chute 30 can push the flaps the rest of the way toward a generally horizontal orientation.

The controller 16 can move the chute 30 or the container support 26 at a variable speed to optimize the cycle time while effectively filling the voids around objects 14 in the container 12. For example, the controller 16 can move the chute 30 from the rest position at a relatively fast rate for a first period of time, and continue moving the chute to the dispensing position at a relatively slower rate that is slower than the first rate for a second period of time. The controller 16 preferably, but not necessarily, begins opening the shutter 50 when the bottom portion of the chute 30 moves into the vicinity of the flaps 36 of the container 12. The flaps also can help to capture the dunnage within the container 12.

Once the chute 30 and the container support 26 are in the dispensing position shown in FIG. 4, the controller 16 can fully open the shutter 50 to the desired aperture size. Opening the shutter 50 allows the dunnage 11 to flow through the aperture 52 by gravity and fill the voids in the container 12. After a predetermined period of time, the shutter 50 closes the aperture 52, thereby separating the remaining dunnage in the chute 30 from the dunnage in the container 12 that is above the shutter 50, and thus above the fill line. See FIG. 6. Alternatively, a void fill level sensor 88 can measure the level of dunnage 11 in the container 12. An optical sensor aligned with the fill level line can be used as the void fill sensor or the sensor can be aligned perpendicular to the fill line to detect the fill level. When the sensor 88 determines that the dunnage 11 has reached the desired fill level the controller 16 automatically closes the shutter 50.

Closing the shutter 50 also levels the dispensed dunnage 11. The container support 26 can include a vibration table to aid in evenly spreading and settling the dunnage 11 in the container 12, before or after closing the shutter 50. Because the dunnage 11 is dispensed through an aperture 52 that approximates the size of the container opening, no further operation is required to spread the dunnage 11 within the container 12.

Once the shutter 50 has closed, the chute 30 can be returned from the dispensing position to the rest position at the faster rate. Closing the shutter 50 and withdrawing the chute 30 relative to the container support 26 also removes all of the dunnage 11 above the shutter. The controller 16 also can control the downstream stop gate 74 and discharge the container 12 from the container support 26 to a closing station, for example, where the flaps 36 can be folded over the opening and securely closed, as by taping for example. If the container is of a type without flaps, a lid can now be placed over the opening and the dunnage therein and secured in place. Although some dunnage 11 might lie above the flap fold line 38 of the container 12, due to the nature of a flowable dunnage the dunnage probably has sufficient resilience or will settle so that closing the flaps 36 will not damage the objects 14 packed within the container 12. Dispensing dunnage 11 to a fill level that is above the flap fold line 38 also allows for some settling of the dunnage during shipment without compromising its void-filling capabilities.

The automated packing system 10 thus presents an exemplary way to automatically fill the voids in a container around one or more objects already placed in the container without significantly under-filling or over-filling the container with void-fill dunnage. The void-filling system has a short cycle time because no subsequent dunnage spreading operation is required, and operates efficiently because the void does not have to be measured before filling the container, which is particularly advantageous with complex-shape objects, and because over-filled dunnage does not have to be recovered with a recirculation system.

Another method for filling a container with void-fill dunnage includes pouring an excess of flowable dunnage over the container to fill the void around one or more articles in the container. A system for employing this method typically requires a recirculation system, however, to recover the overflow.

Figure 8:
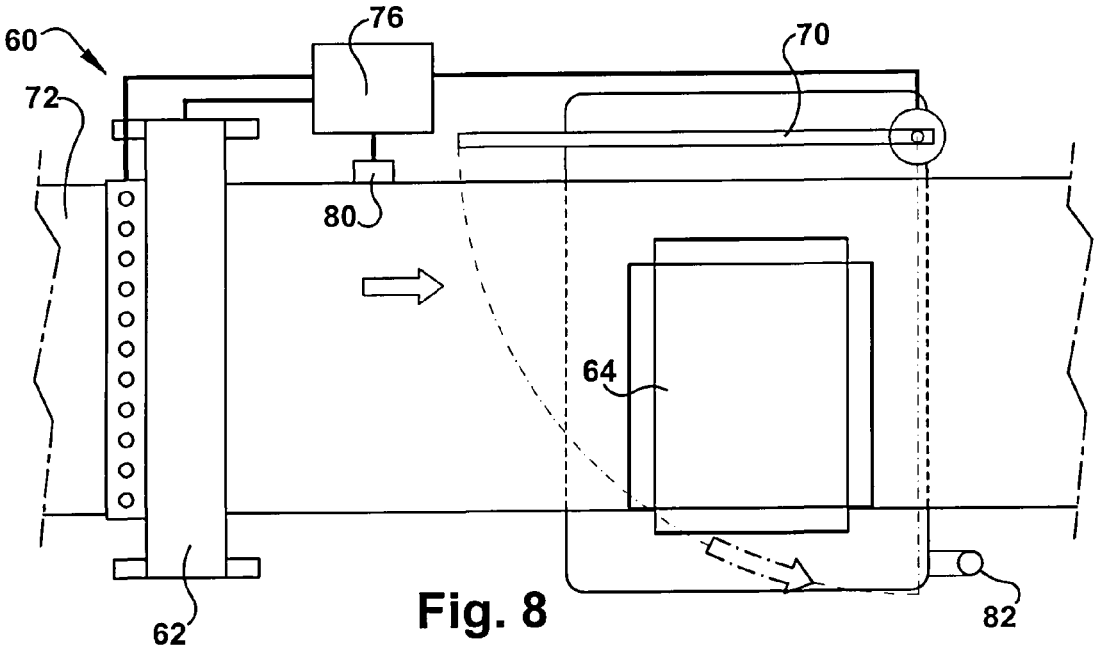
FIG. 8 is a schematic top view of the system of FIG. 7.

Such a system 60 for employing this method is shown in FIGS. 7 and 8, and generally includes a device 62 for folding down the flaps 63 of a container 64, a source of dunnage 66 and a wiper 70 to clear excess dunnage above a horizontal fill plane at or above the top of the container 64. The flap-folding device 62 folds the flaps at a fold line to a position at or below horizontal so that the wiper 70 can sweep across the top of the container 64 unimpeded by the flaps. The system 60 shown in FIGS. 7 and 8 also includes a container support in the form of a conveyor 72 that moves the container 64 past the flap-folding device 62, the source of dunnage 66, and the wiper 70.

In the illustrated system 60 the source of dunnage 66 includes a hopper 74 for storing and dispensing a supply of flowable void-fill dunnage. The source 66 can include a machine for making the dunnage directly for dispensation or for filling the hopper 74 until it is needed. The hopper 74 is controlled by a controller 76 to dispense dunnage either continuously or intermittently to a container 64 as it passes through a fill zone beneath the hopper 74. The system can also include a sensor 80 for detecting a container 64 entering the fill zone, whereupon the controller 76 can control the hopper 74 to dispense dunnage. The controller can control the speed at which the conveyor 72 moves the container 64 through the fill zone, and can stop the container 64 in the fill zone for a predetermined dwell period to fill the void in the container 64 with dunnage and mound the dunnage above the top of the container 64. Excess dunnage that misses or overflows the container 64 is recovered by a recirculating assembly 82 and returned to the hopper 74.

The wiper 70 is configured to clear excess dunnage from the widest container 64 expected in the system 60. Accordingly, the wiper preferably can extend across the full width of the container support, which in this case is the conveyor 72. The wiper 70 mechanically moves or pushes the excess dunnage above the fill plane from the container 64 for recovery by the recirculating assembly 82. The wiper 70 is configured to remove all of the dunnage that is above the top of the container 64, in the case of a fill plane at the top of the container 64, or alternatively can be positioned to leave a predetermined amount of excess dunnage up to a fill plane spaced above the top of the container 64. The illustrated wiper is mounted to one side of the conveyor for rotation about an axis that causes the wiper to sweep across the conveyor at a predetermined height. The wiper 70 also can be vertically adjustable so that it can be configured to clear excess dunnage from containers having different heights or to clear excess dunnage from containers at fill planes with different spacing from a top of a container.

Figure 9:
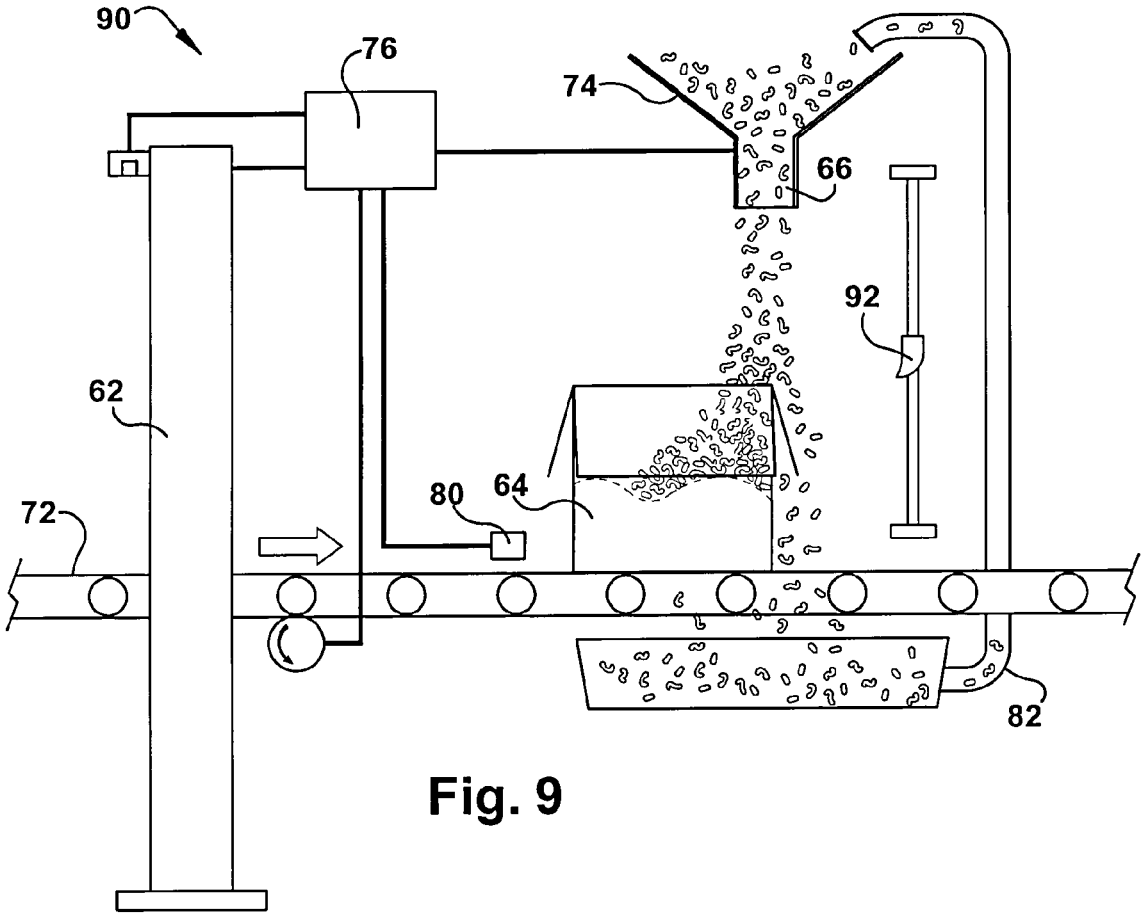
FIGS. 9 and 10 are schematic side views of a variation of the system shown in FIGS. 7 and 8.
Figure 10:
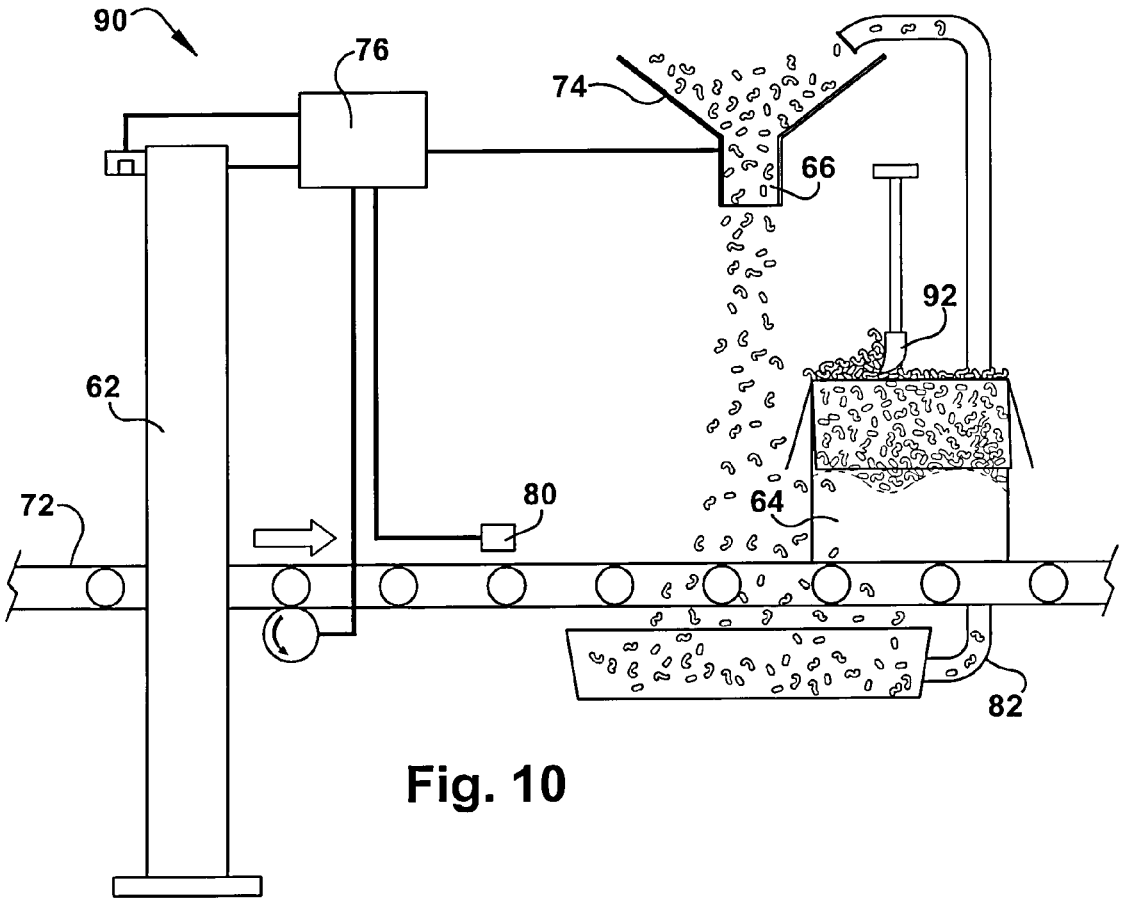

In a variation on this embodiment, shown in FIGS. 9 and 10, a system 90 includes many of the same features of the system 60 shown in FIGS. 7 and 8. In this system 90 a stationary wiper 92 extends continuously across the path of a container 12 downstream of the dunnage dispenser 66. The wiper 92 provides an obstruction under which the container is moved as it passes out of the fill zone. The wiper 92 is vertically adjustable for use with different size containers, and its lower edge defines the fill line, typically, but not necessarily, a straight horizontal line.

This system 90 also is suitable for a continuous dunnage filling process. The dunnage dispenser dispenses dunnage continuously as the container 12 moves thereunder, intentionally over-filling the container. The wiper 92 then levels the dunnage at the fill plane as the container 12 is moved thereunder. The wiper 92 also spreads the dunnage in an upstream direction and directs the excess dunnage removed from the container 12 to the recirculation system 82.

Figure 11:
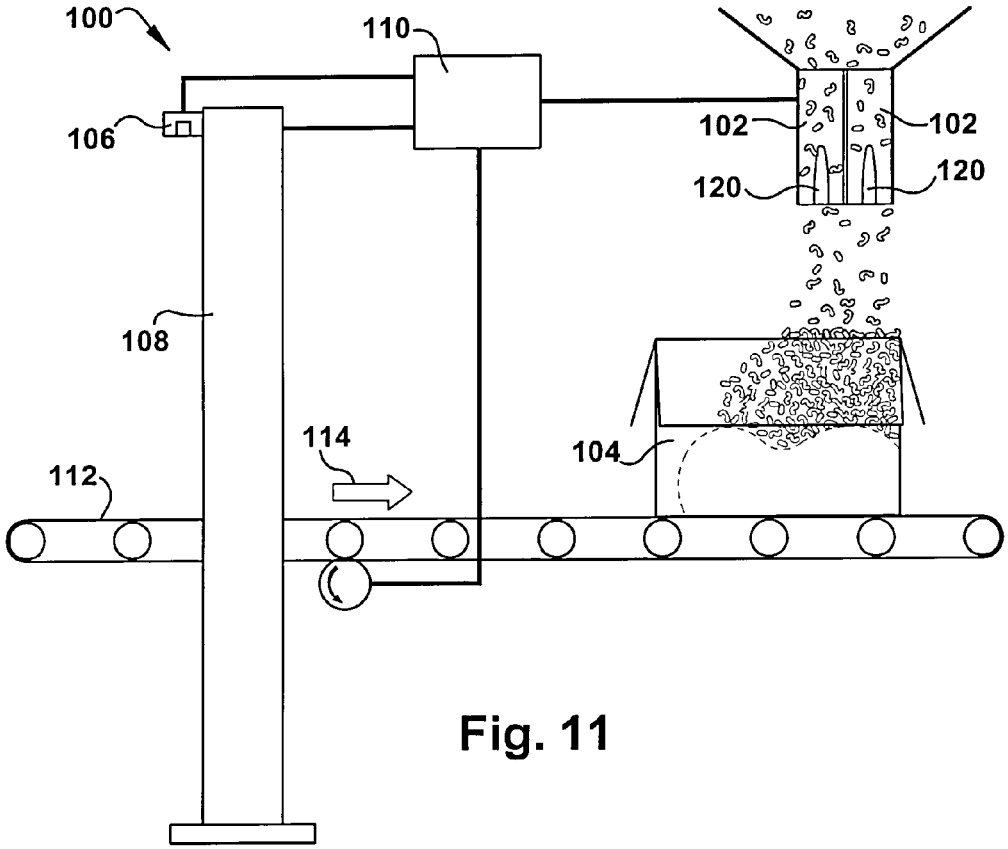
FIG. 11 is a schematic side view of yet another automated dunnage filling system according to the present invention.
Figure 12:
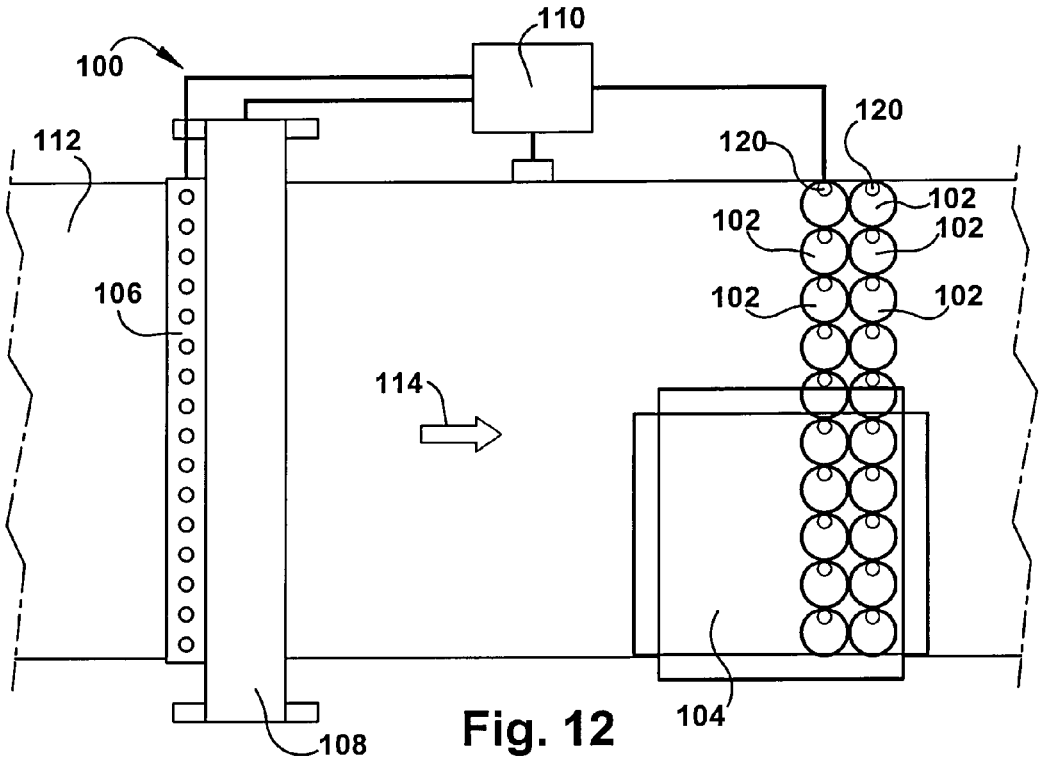
FIG. 12 is a schematic top view of the system of FIG. 11.

Yet another system 100 is shown in FIGS. 11 and 12 that includes one or more relatively small fill chutes 102 that are individually controllable to open and close as needed, depending on the size or shape of the container, to fill the void in a container 104 with void-fill dunnage. Unlike the systems described above, this system 100 does not include either a wiper or a shutter to fill the void around one or more objects in the container.

Specifically, the system 100 includes a dispenser having a source of dunnage that includes one or more outlets at the ends of each of one or more fill chutes 102, and a controller 110 for controlling and communicating between the various elements of the system 100, including controlling opening and closing of the outlets to dispense dunnage therefrom over a desired area. Typically, the fill chutes 102 are spaced across an area corresponding to the width of the widest container for which the system 100 is designed. The illustrated embodiment includes a plurality of outlets and fill chutes 102 arranged in a regular array. Alternatively, a single outlet and fill chute can be used, or a plurality of outlets and fill chutes can be provided in irregular positions across the designed width, such as providing more outlets near the side of the conveyor against which the containers are registered. The fill chutes 102 can be individually selectively opened to dispense dunnage from selected portions of an area corresponding to the collective areas of the plurality of outlets.

The illustrated system 100 also includes a width sensor 106 upstream of the chutes 102. The system 100 can also include a device 108 for folding down the flaps of a container 104. The width sensor 106 measures the width of a container 104. A height sensor also can be used in this system. The width sensor 106 generally extends across the width of the path of the container 104, which can be defined by a conveyor 112 that moves the container 104 through the system 100. The width sensor 106 can include a linear array of photosensors, for example, that extends across the width of the conveyor 112. The illustrated fill chutes 102 are arrayed across the width of the conveyor 110 perpendicular to the conveying direction 114. The width of the container 104, as measured by a width sensor 106 upstream of the fill chutes, is used to determine which chutes 102 need to be enabled to open to fill the void in the container 104.

The chutes 102 and/or the container 104 are moved relative to one another as the chutes 102 dispense the dunnage to fill the void in the container 104. In the illustrated embodiment the conveyor 110 moves the container 104 relative to the chutes 102. The system 100 can also include a mechanism for registering the container 104 relative to the conveyor 110, such as toward one side of the conveyor, and thus toward one side of the chutes 102. The array can include a single row of chutes 102 for dispensing dunnage as the array and the container 104 move relative to each other, or a plurality of rows for faster filling or to quickly fill a container 104 held in a fixed position relative to the array of chutes 102 that overlays a substantial portion of the opening in the top of the container 104.

In the illustrated embodiment each chute 102 has its own sensor 120 associated therewith for measuring the distance relative to a container support and estimating the fill level of the dunnage in the container 104. The controller 110 can use input from the sensor or sensors 120 to determine when to close the chutes 102, for example when that part of the container below the chute 102 reaches a predetermined fill level or the end of the container 104 is reached as the container moves past the chute 102. Fewer sensors can be spaced across a widthwise direction to monitor the fill level in various areas of a container. The system thus provides additional flexibility in providing different amounts or types of dunnage to different areas within a container.

Both of these latter systems automatically dispense dunnage to fill the void around one or more objects in a container without requiring the assistance of an operator, no vertical movement is required between the container and the source of dunnage, which facilitates using these systems with containers having different heights, and neither system requires any measurement of the void volume in advance of the filling operation. Unlike the system shown in FIG. 1, however, these systems require a recirculation system.

Although the invention has been shown and described with respect to a certain embodiment or embodiments, equivalent alterations and modifications will occur to others skilled in the art upon reading and understanding this specification and the annexed drawings. In particular regard to the various functions performed by the above described integers (components, assemblies, devices, compositions, etc.), the terms (including a reference to a "means") used to describe such integers are intended to correspond, unless otherwise indicated, to any integer that performs the specified function of the described integer (i.e., that is functionally equivalent), even though not structurally equivalent to the disclosed structure that performs the function in the herein illustrated exemplary embodiment of the invention.

What is claimed:

1. A method of dispensing a flowable dunnage into a container comprising the steps of sensing a dimension of a container, adjusting the size of an aperture at the outlet of a dunnage dispenser based on the sensed dimension while the aperture is closed by a shutter, relatively positioning the outlet of the dunnage dispenser above the container, and opening the shutter to allow dunnage to flow into the container.

2. A method according to claim 1, wherein the positioning step includes moving the outlet to a position in close proximity to the top edge or edges of the side wall or walls of the container.

3. A method according to claim 1, wherein the positioning step includes moving the outlet vertically.

4. A method according to claim 1, comprising the step of positioning a container on a container support in a position aligned with the dispenser outlet.

5. A method according to claim 4, wherein the step of positioning the container includes registering one corner of a rectangular container relative to a respective corner of the outlet where the outlet has a rectangular shape.

6. A method according to claim 4, wherein the step of positioning the container includes moving the container in one or more generally horizontal directions.

7. A method according to claim 1, wherein the adjusting step includes moving one or more transversely movable closure members to vary the size of the aperture.

8. A method according to claim 7, wherein the adjusting step includes moving at least two closure members to define the aperture.

9. A method according to claim 7, wherein opening the shutter includes moving fewer than all of the closure members.

10. A method according to claim 1, wherein the positioning step includes moving the bottom portion of a chute from a rest position at a relatively fast rate for a first period of time and continuing to a dispensing position at a relatively slower rate that is slower than the first rate for a second period of time.

11. A method according to claim 10, wherein the positioning step includes moving the bottom portion of the chute from the dispensing position to a rest position at the faster rate.

12. A method according to claim 1, wherein the sensing step includes sensing at least one of a height, width, or depth dimension or combinations thereof, of a container.

13. A method according to claim 1, wherein the step of opening the shutter can begin before the positioning step is complete.

14. A method according to claim 1, comprising the steps of relatively positioning an outlet of a dispenser such that the shutter closing the outlet is located in close proximity to the top edge or edges of the side wall or walls of a container, and the opening step includes moving the shutter from a closed position through a plane that is parallel to the top edge or edges to open the shutter to allow dunnage to flow from the dispenser into the container.

* * * * *